US010332669B2

(12) United States Patent
Chang et al.

(10) Patent No.: US 10,332,669 B2
(45) Date of Patent: Jun. 25, 2019

(54) ELECTROMAGNETIC COMPONENT AND FABRICATION METHOD THEREOF

(71) Applicant: CYNTEC CO., LTD., Hsinchu (TW)

(72) Inventors: Wei-Chien Chang, Hsinchu County (TW); Chia-Chi Wu, New Taipei (TW); Lang-Yi Chiang, Keelung (TW); Tsung-Chan Wu, Hsinchu (TW); Jih-Hsu Yeh, Taipei (TW)

(73) Assignee: CYNTEC CO., LTD., Hsinchu (TW)

( * ) Notice: Subject to any disclaimer, the term of this patent is extended or adjusted under 35 U.S.C. 154(b) by 479 days.

(21) Appl. No.: 14/621,409

(22) Filed: Feb. 13, 2015

(65) Prior Publication Data

US 2015/0155091 A1 Jun. 4, 2015

Related U.S. Application Data

(63) Continuation of application No. 13/868,993, filed on Apr. 23, 2013, now Pat. No. 9,009,951.

(60) Provisional application No. 61/637,277, filed on Apr. 24, 2012.

(51) Int. Cl.

| | |
|---|---|
| ***H01F 27/28*** | (2006.01) |
| ***H01F 5/02*** | (2006.01) |
| ***H01F 5/00*** | (2006.01) |
| ***H01F 27/29*** | (2006.01) |
| ***H01F 41/04*** | (2006.01) |
| *H01F 17/04* | (2006.01) |

(52) U.S. Cl.

CPC ..... *H01F 27/2804* (2013.01); *H01F 5/003* (2013.01); *H01F 5/02* (2013.01); *H01F 27/292* (2013.01); *H01F 41/04* (2013.01); *H01F 2017/048* (2013.01); *H01F 2027/2809* (2013.01); *Y10T 29/49002* (2015.01); *Y10T 29/4902* (2015.01); *Y10T 29/49071* (2015.01); *Y10T 29/49073* (2015.01); *Y10T 29/49075* (2015.01)

(58) Field of Classification Search

CPC ..... H01F 5/00; H01F 27/28
USPC ..... 336/200, 232
See application file for complete search history.

(56) References Cited

U.S. PATENT DOCUMENTS

| | | | | |
|---|---|---|---|---|
| 6,847,284 | B2 * | 1/2005 | Gamou | H01F 27/2804 336/192 |
| 2004/0051621 | A1 * | 3/2004 | Nakata | H01F 27/027 336/223 |
| 2004/0145442 | A1 * | 7/2004 | Matsutani | H01F 21/12 336/200 |
| 2006/0038651 | A1 * | 2/2006 | Mizushima | H01F 17/04 336/83 |
| 2006/0220776 | A1 * | 10/2006 | Fujiwara | H01F 17/0006 336/200 |

(Continued)

FOREIGN PATENT DOCUMENTS

| | | | | |
|---|---|---|---|---|
| JP | 2005064321 A | * | 3/2005 | |
| JP | 2007067214 A | * | 3/2007 | |
| WO | WO 9700526 A1 | * | 1/1997 | H01F 17/0013 |

*Primary Examiner* — Tszfung J Chan

(74) *Attorney, Agent, or Firm* — Min-Lee Teng; Litron Patent & Trademark Office

(57) ABSTRACT

An electromagnetic component includes a coil portion with a multi-layer stack structure, a molded body encapsulating the coil portion, and two electrodes respectively coupled to two terminals of the coil portion. The coil portion is fabricated using plating, laminating and/or pressing manufacturing techniques.

6 Claims, 15 Drawing Sheets

(56) References Cited

U.S. PATENT DOCUMENTS

2013/0249664 A1* 9/2013 Tonoyama ..... H01F 27/255
336/200
2013/0263440 A1* 10/2013 Lee ..... H01F 41/04
29/605

* cited by examiner

ELECTROMAGNETIC COMPONENT AND FABRICATION METHOD THEREOF

CROSS REFERENCE TO RELATED APPLICATIONS

This application is a continuation of U.S. application Ser. No. 13/868,993, filed Apr. 23, 2013, which claims priority from U.S. provisional application No. 61/637,277, filed Apr. 24, 2012.

BACKGROUND OF THE INVENTION

1. Field of the Invention

The present invention relates generally to electromagnetic components and, more particularly, to a surface-mounting electromagnetic component with a coil portion that may be constructed using plating, laminating and/or pressing manufacturing techniques.

2. Description of the Prior Art

As known in the art, electromagnetic components such as inductors or choke coils have typically been constructed by winding conductors about a cylindrical core. For example, insulated copper wires may be wrapped around the outer surface of the core. Structures of such electromagnetic components are usually designed to meet the surface mounting technology (SMT) or surface mounting device (SMD).

The rapid advance toward electronic components having smaller size and higher performance in recent years is accompanied by strong demand for coil elements having smaller size and higher performance in terms of saturation current ($I_{sat}$) and DC resistance (DCR). However, the size of the prior art coil element is difficult to shrink further.

What is needed, therefore, is an improved electromagnetic component having better performance such as larger saturation current, reduced DC resistance and better efficiency, while the size of the electromagnetic component can be miniaturized.

SUMMARY OF THE INVENTION

It is one object of the invention to provide an electromagnetic component which can be formed with a smaller size and can be constructed using plating, laminating and/or pressing manufacturing techniques with high yield.

The above-described object is achieved by an electromagnetic component including a coil portion with a multi-layer stack structure; a molded body encapsulating the coil portion; and two electrodes respectively coupled to two terminals of the coil portion. Each layer of the multi-layer stack structure may have a line width of about 180-240 micrometers and a thickness of about 40-60 micrometers. The coil portion is fabricated using plating, laminating and/or pressing manufacturing techniques.

This disclosure also includes a method of fabricating an electromagnetic component. First, a coil portion having a multi-layer stack structure is provided. A molded body is employed to encapsulate the coil portion. The molded body comprises a magnetic material. Two electrodes are then formed to electrically connect two terminals of the coil portion respectively.

In one aspect, there is disclosed a method of fabricating a coil portion of the electromagnetic component including the steps of: providing a substrate; forming a first patterned photoresist layer on the substrate, the first patterned photoresist layer comprising an opening; filling the opening with plated copper, thereby forming a first conductive trace; removing the patterned photoresist layer; covering the first conductive trace with a dielectric layer having thereon a via hole; plating a copper layer over the dielectric layer, wherein the copper layer fills the via hole; forming a second patterned photoresist layer on the copper layer; and etching the copper layer not covered by the second patterned photoresist layer, thereby forming a second conductive trace stacked on the first conductive trace, wherein the first and second conductive traces constitute a winding of the coil portion.

According to another embodiment, a method of fabricating a coil portion of the electromagnetic component includes providing a substrate having thereon a first patterned conductive trace; laminating the substrate with a build-up layer including an insulating layer and a copper foil; forming a blind via in the build-up layer; forming a plated copper layer on the build-up layer, wherein the plated copper layer fills into blind via to form a via electrically connecting the first conductive trace to the plated copper layer; and patterning the plated copper layer and the copper foil thereby forming a second patterned conductive trace, wherein the first and second patterned conductive traces constitute a winding of the coil portion.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings:

FIG. 13 and FIG. 14 illustrate an exemplary electromagnetic component according to another embodiment of this invention, wherein FIG. 13A and FIG. 13B are different perspective views of a coil portion of the electromagnetic component, wherein

It should be noted that all the figures are diagrammatic. Relative dimensions and proportions of parts of the drawings are exaggerated or reduced in size, for the sake of clarity and convenience. The same reference signs are generally used to refer to corresponding or similar features in modified and different embodiments.

DETAILED DESCRIPTION

In the following description, numerous specific details are given to provide a thorough understanding of the invention.

It will, however, be apparent to one skilled in the art that the invention may be practiced without these specific details. Furthermore, some well-known system configurations and process steps are not disclosed in detail, as these should be well-known to those skilled in the art. The scope of the invention is not limited by the flowing embodiments and examples.

Figure 1:
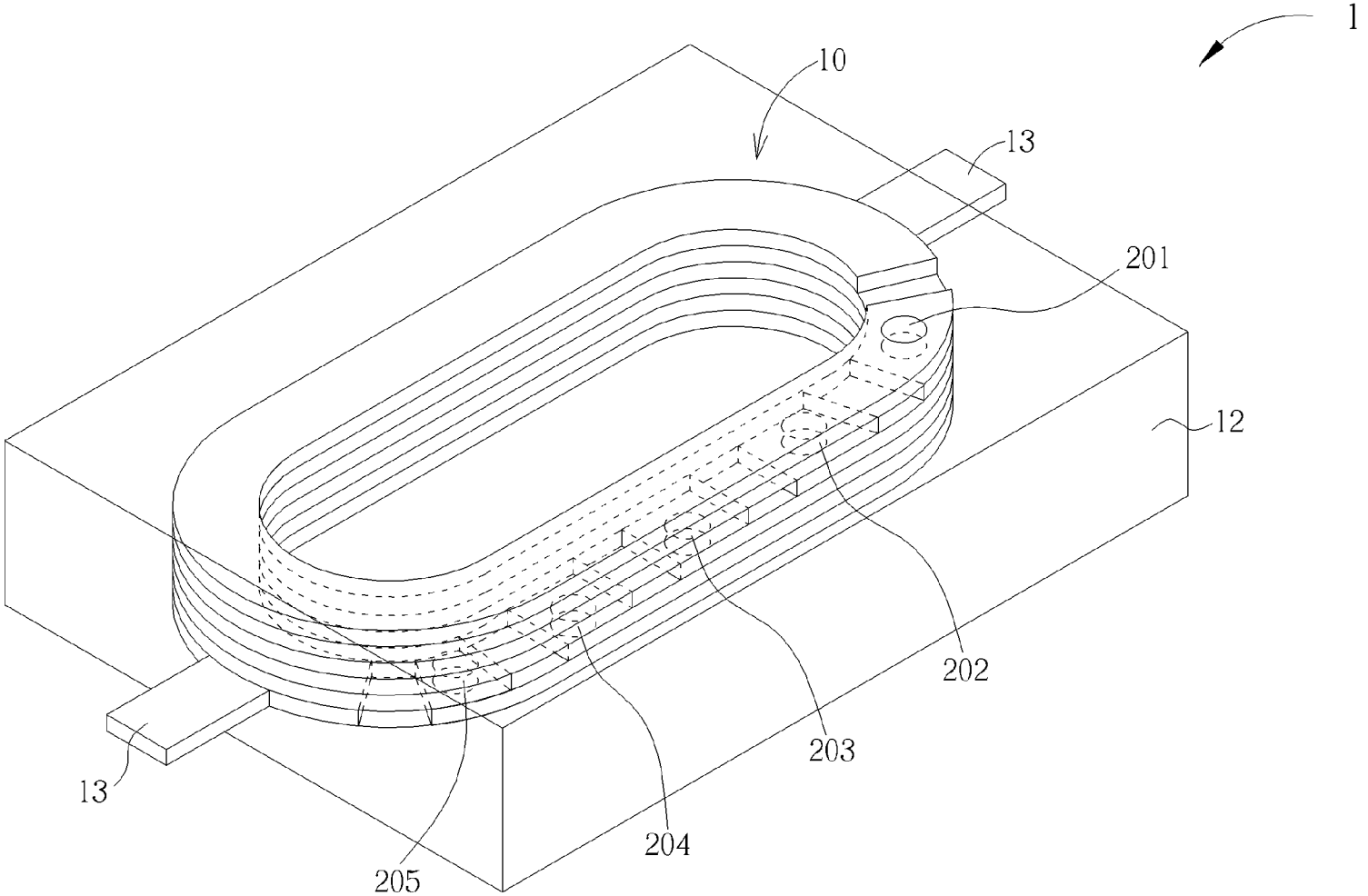
FIG. 1 is a schematic, perspective view showing an electromagnetic component in accordance with one embodiment of this invention.
Figure 2:
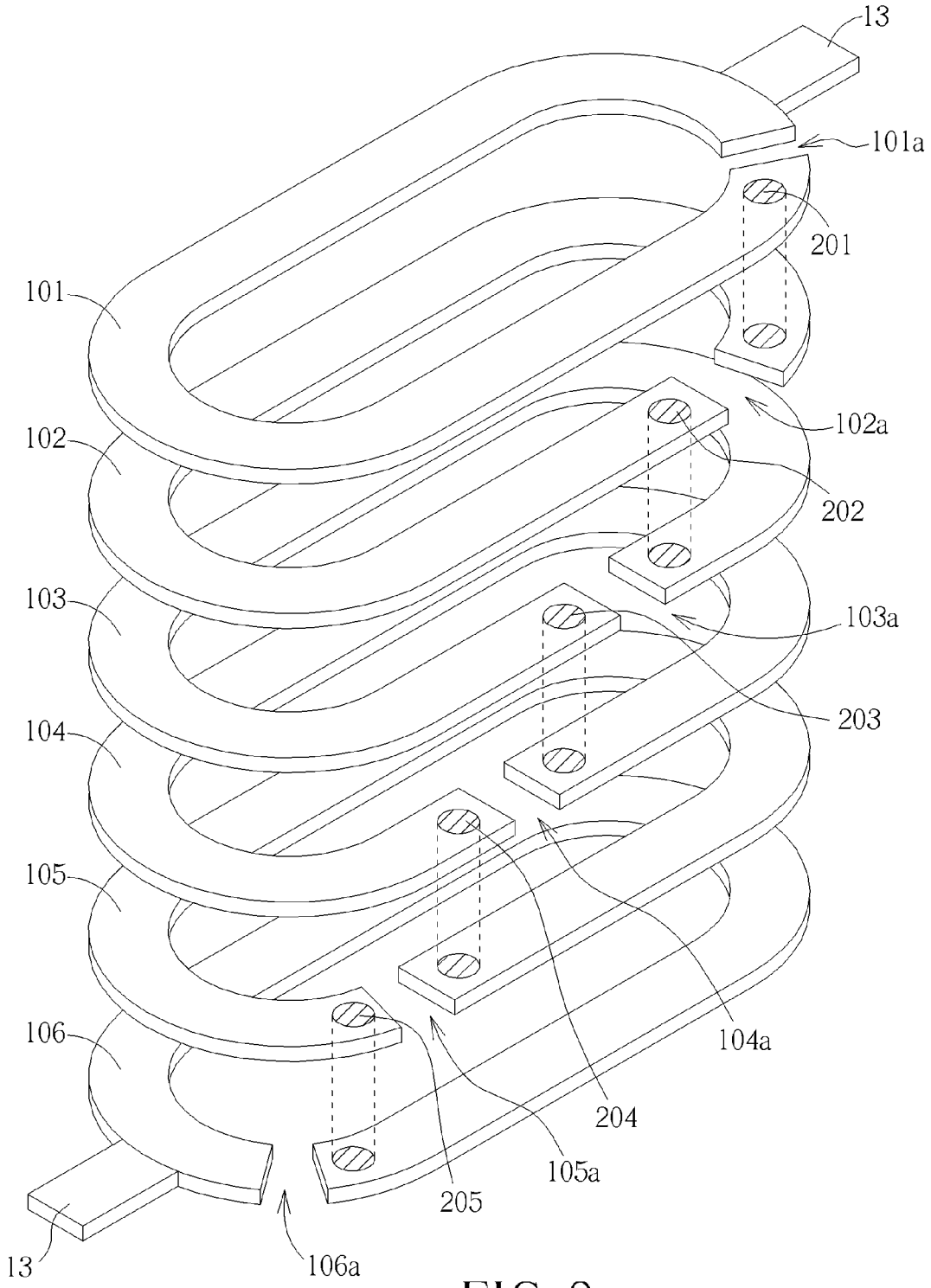
FIG. 2 is a schematic exploded view of the coil portion of the electromagnetic component in FIG. 1.

Please refer to FIGS. 1 and 2. FIG. 1 is a schematic, perspective view showing an electromagnetic component in accordance with one embodiment of this invention. FIG. 2 is an exploded view of the coil portion of the electromagnetic component in FIG. 1. As shown in FIGS. 1 and 2, the electromagnetic component 1, such as a choke coil or an inductor, comprises a single-winding coil portion 10 encapsulated by a molded body 12 formed in a shape of, for example, rectangular parallelepiped, cubic shaped or any suitable shapes, and two electrodes 13 respectively coupled to two terminals of the coil portion 10. The electrodes 13 may stretch out from two opposite surfaces of the molded body 12. According to the embodiment of this invention, the molded body 12 may comprise magnetic material including but not limited to a thermosetting resin and metallic powder such as ion powder, ferrite powder, metallic powder or any suitable magnetic materials known in the art.

According to the embodiment of this invention, the two electrodes 13 may be integrally formed with the corresponding layers of the coil portion 10. However, it is to be understood that the two electrodes 13 may be a part of a leadframe in another embodiment. The two electrodes 13 may be bent along the surfaces of the molded body 12 to facilitate the implementation of the surface mounting technology.

According to the embodiment of this invention, the coil portion 10 may be fabricated using plating, laminating and/or pressing manufacturing techniques, which will be described in detail later. According to the embodiment of this invention, the coil portion 10 is a single-winding, multi-layer stack structure, for example, a six-layer metal stack structure in FIG. 2. Each layer, for example, indicated with labels 101-106 in FIG. 2, of the coil portion 10 may have a line width of about 180-240 micrometers, for example, 210 micrometers, and a thickness of about 40-60 micrometers, for example, 46 micrometers. The layers 101-106 are insulated from each other using intervening insulating layers (not explicitly shown). For the sake of simplicity and clarity, the insulating layers between the layers 101-106 of the coil portion 10 are omitted in FIGS. 1-2. According to the embodiment of this invention, each of the insulating layers may have a thickness of about 2-10 micrometers, for example, 5 micrometers. The number of the layers of the coil portion 10 may range between two and eight, for example. However, it is to be understood that the number of the layers of the coil portion 10 depends on the design requirements and is adjustable. The scope of the invention is therefore not limited by this example.

According to the embodiment of this invention, each layer of the coil portion 10 may be an annular, oval-shaped stripe pattern when viewed from above, and is not a close loop. A slit, which is indicated with labels 101*a*-106*a* in FIG. 2, is provided between two distal ends of each oval-shaped layer. According to the embodiment of this invention, the slits 101*a*-106*a* of the coil portion 10 are not aligned in the thickness direction, and have an offset between two slits of adjacent layers, for example, 150-180 micrometers in clockwise direction of the loop, such that the rear end of the upper layer, for example, layer 101, is electrically connected to the front end of the lower layer, for example, layer 102, by means of a via, which is indicated with labels 201-205, thereby forming series connection of the turns of the single winding. Each of the vias 201-205 extends through the thickness of each insulating layer (not explicitly shown) between the layers 101-106 and may have a diameter of about 180 micrometers, for example.

Figure 3:
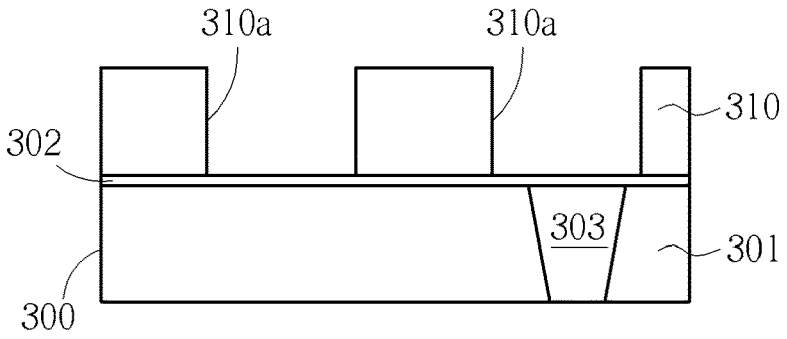
FIGS. 3-12 are schematic, cross-sectional diagrams showing a method for fabricating an electromagnetic component in accordance with one embodiment of this invention.

FIGS. 3-12 are schematic, cross-sectional diagrams showing a method for fabricating an electromagnetic component in accordance with one embodiment of this invention. As shown in FIG. 3, first, a substrate 300 such as a copper clad laminate (CCL) substrate is provided. The substrate 300 may have thereon at least one copper layer 302 laminated on an insulating core 301 made of, for example, dielectric or epoxy glass, and at least one via 303 extending through the thickness of the substrate 300. The via 303 may be a plated through hole that may be fabricated using conventional mechanical or laser drill processes and plating methods. For the sake of simplicity, only the layers fabricated on one side of the substrate 300 are demonstrated. It is to be understood that the same stack structure may be fabricated on the other side of the substrate 300 using similar process steps as disclosed in this embodiment.

A patterned photoresist layer 310 is then provided on the surface of the substrate 300. The patterned photoresist layer 310 comprises openings 310*a* exposing a portion of the copper layer 302. For example, each of the openings 310*a* has a width of about 210 micrometers and a depth of about 50 micrometers.

Figure 4:
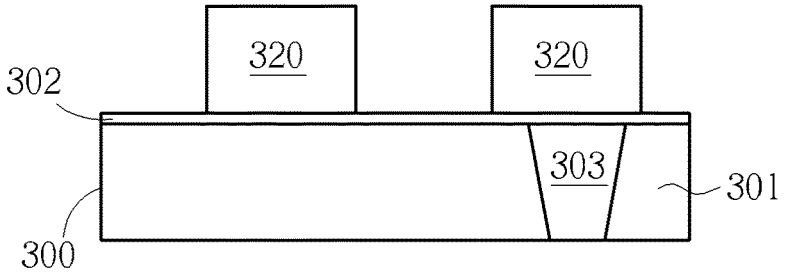

As shown in FIG. 4, an electroplating process is carried out to fill the openings 310*a* with plated copper, thereby forming first conductive traces 320 having a width of about 210 micrometers and a thickness of about 46 micrometers. Subsequently, the patterned photoresist layer 310 is stripped off. The first conductive traces 320 may have a shape or pattern that is similar to layers 101-106 as depicted in FIGS. 1-2. It is noteworthy that each of the first conductive traces 320 has a vertical sidewall profile.

Figure 5:
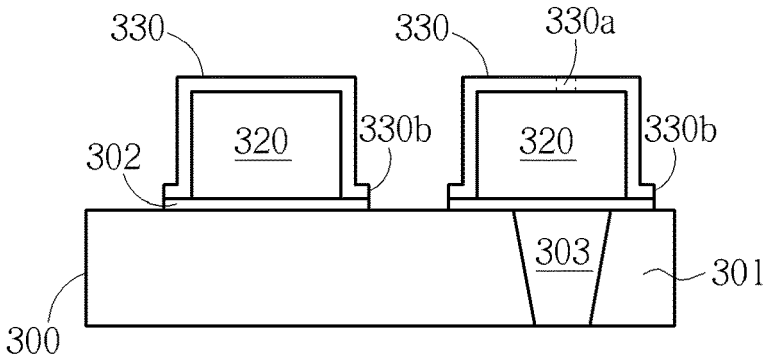

As shown in FIG. 5, after forming the first conductive traces 320, the copper layer 302 between first conductive traces 320 is removed. Subsequently, a dielectric layer 330 is provided to conformally cover the first conductive traces 320. A via hole 330*a* is formed in the dielectric layer 330 to expose a portion of the top surface of each of the first conductive traces 320. The dashed line of the via hole 330*a* indicates that the via hole 330*a* is not coplanar with the cross-section shown in this figure. An opening 330*b* may be provided in the dielectric layer 330 between the first conductive traces 320.

Figure 6:
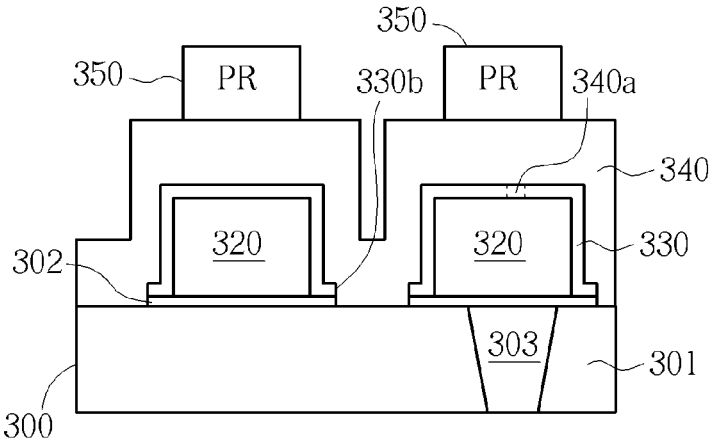

As shown in FIG. 6, an electroplating process may be carried out to form a copper layer 340 over the substrate 300. A copper seed layer (not shown) may be formed using sputtering methods prior to the formation of the copper layer 340. The copper layer 340 may fill the via hole 330*a* to form a via 340*a*. Further, the copper layer 340 may fill the opening 330*b*. A patterned photoresist layer 350 is then formed on the copper layer 340 for defining the pattern of the second layer of a coil portion of the electromagnetic component.

Figure 7:
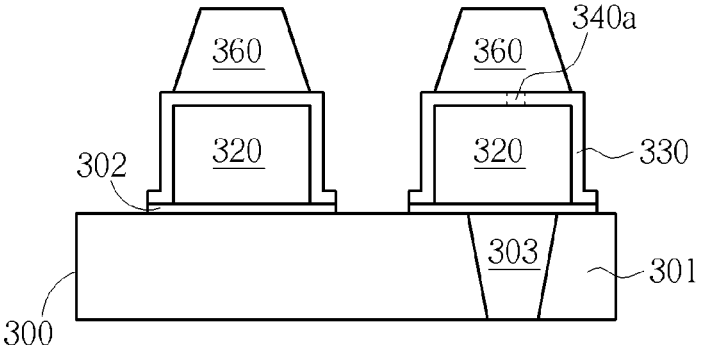

As shown in FIG. 7, the copper layer 340 that is not covered by the patterned photoresist layer 350 is etched away using, for example, wet etching methods, thereby forming second conductive traces 360 stacked on respective first conductive traces 320. The second conductive traces 360 may have a shape or pattern that is similar to layers 101-106 as depicted in FIGS. 1-2 and are electrically connected to the underlying first conductive traces 320 through the vias 340*a*. It is noteworthy that each of the second conductive traces 360 may have a tapered sidewall profile, but not limited thereto.

Figure 8:
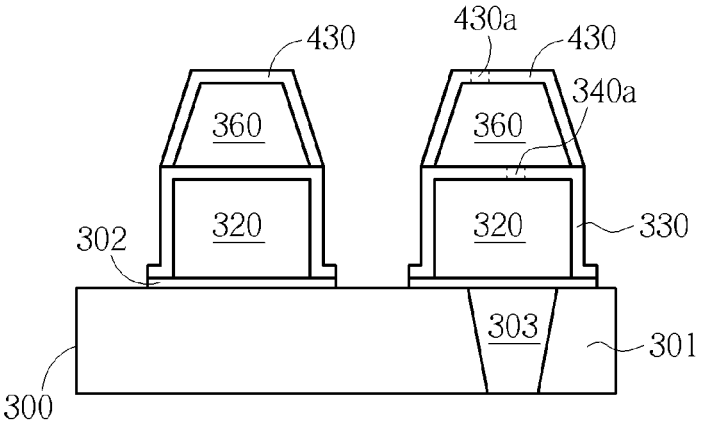
Figure 9:
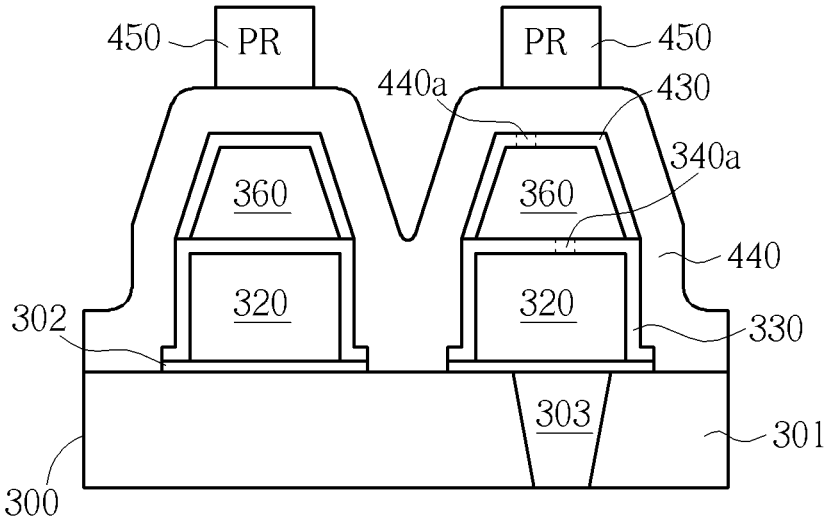
Figure 10:
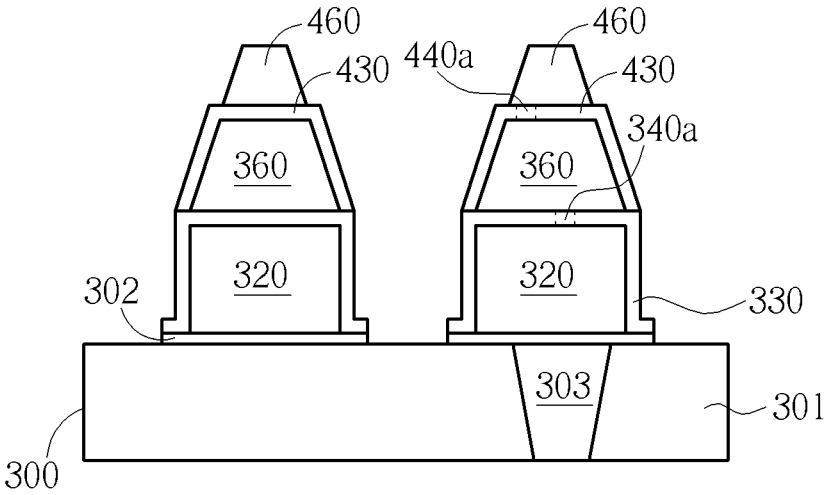

As shown in FIGS. 8-10, similar process steps as depicted through FIG. 5 to FIG. 7 are repeated to form a dielectric layer 430 with via holes 430*a* therein on the second conductive traces 360 (FIG. 8), wherein the via holes 430*a* and via hole 330*a* are situated in different cross sections (similar to the misaligned vias in FIG. 2), a copper layer 440 plated on the substrate 300 in a blanket manner, via 440*a* in the via holes 430*a*, a patterned photoresist layer 450 on the copper layer 440 (FIG. 9), and third conductive traces 460 (FIG. 10). Likewise, the third conductive traces 460 may have a shape or pattern that is similar to layers 101-106 as depicted in FIGS. 1-2 and are electrically connected to the underlying second conductive traces 360 through the vias 440*a*. Each of the third conductive traces 460 may have a tapered sidewall profile, but not limited thereto.

Figure 11:
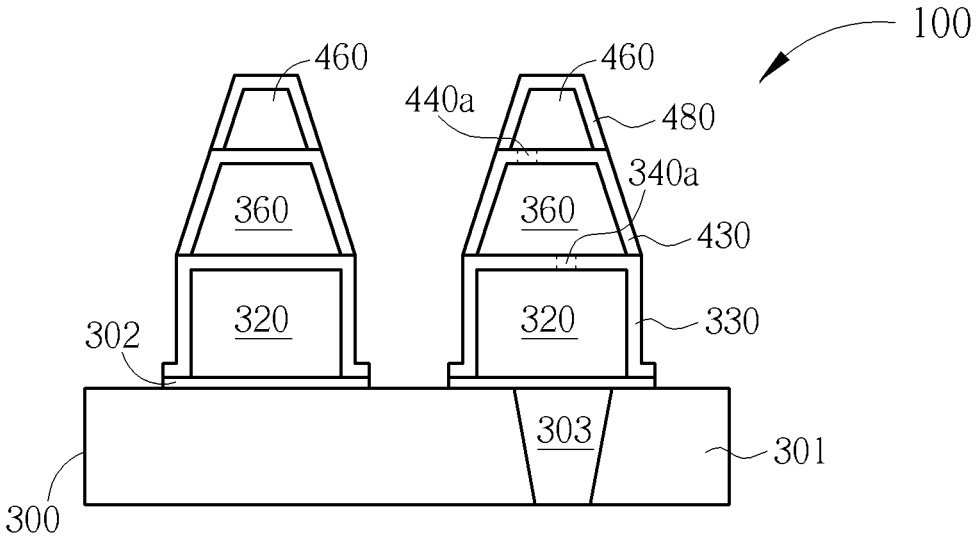

As shown in FIG. 11, a dielectric layer 480 is provided to conformally cover the third conductive traces 460 to thereby complete the coil stack structure 100 on one side of the substrate 300. As previously mentioned, the same coil stack structure may be fabricated using the above-described steps on the other side of the substrate 300.

Figure 12:
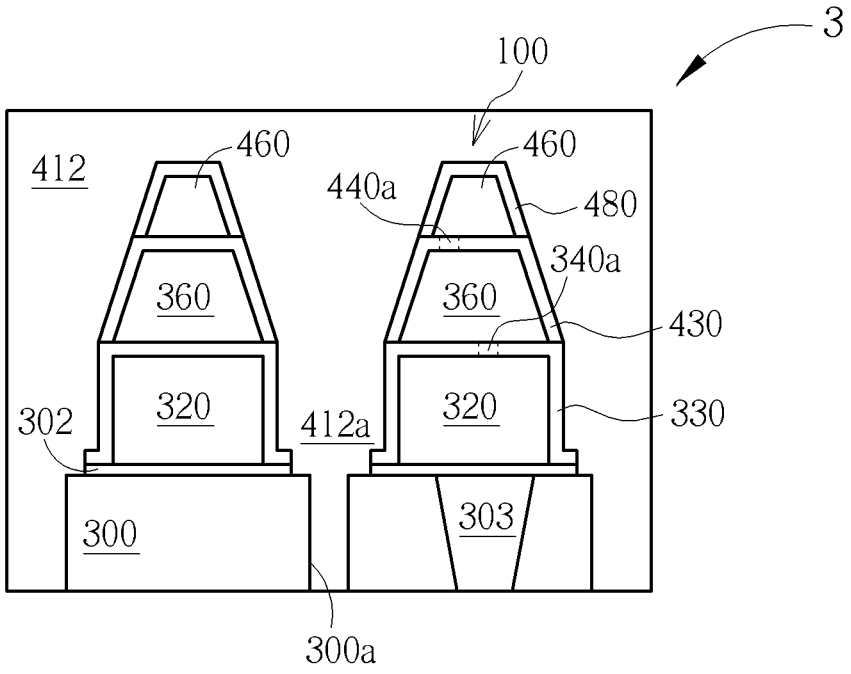

As shown in FIG. 12, a portion of the substrate 300 is removed by using laser or mechanical drilling methods to thereby form a central opening 300*a* in the coil stack structure 100. A packaging process is then performed to encapsulate the coil stack structure 100 with a molded body 412 that is composed of magnetic material comprising resins and magnetic powder. The molded body 412 fills into the central opening 300*a* to form a central pillar 412*a*. The coil stack structure 100 surrounds the central pillar 412*a*, thereby forming an electromagnetic component 3. It is noteworthy that this figure merely depicts the coil stack structure 100 on one side of the substrate 300. Of course, the electromagnetic component 3 may comprise the same coil stack structure on the other side of the substrate 300, which is also encapsulated by the molded body 412.

Figure 13A:
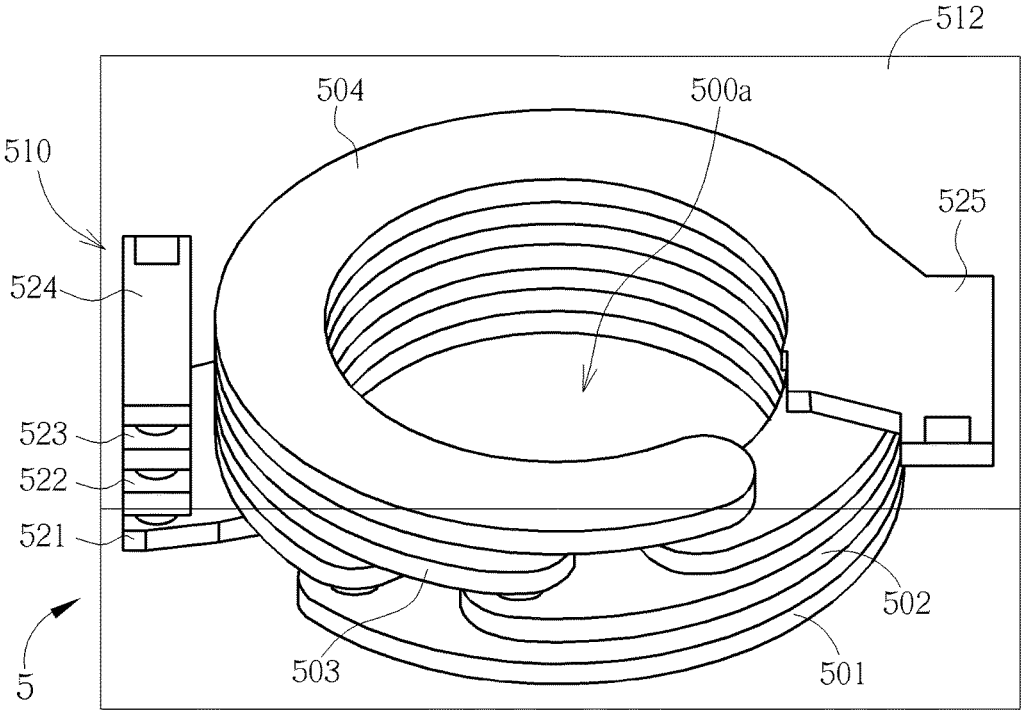
Figure 13B:
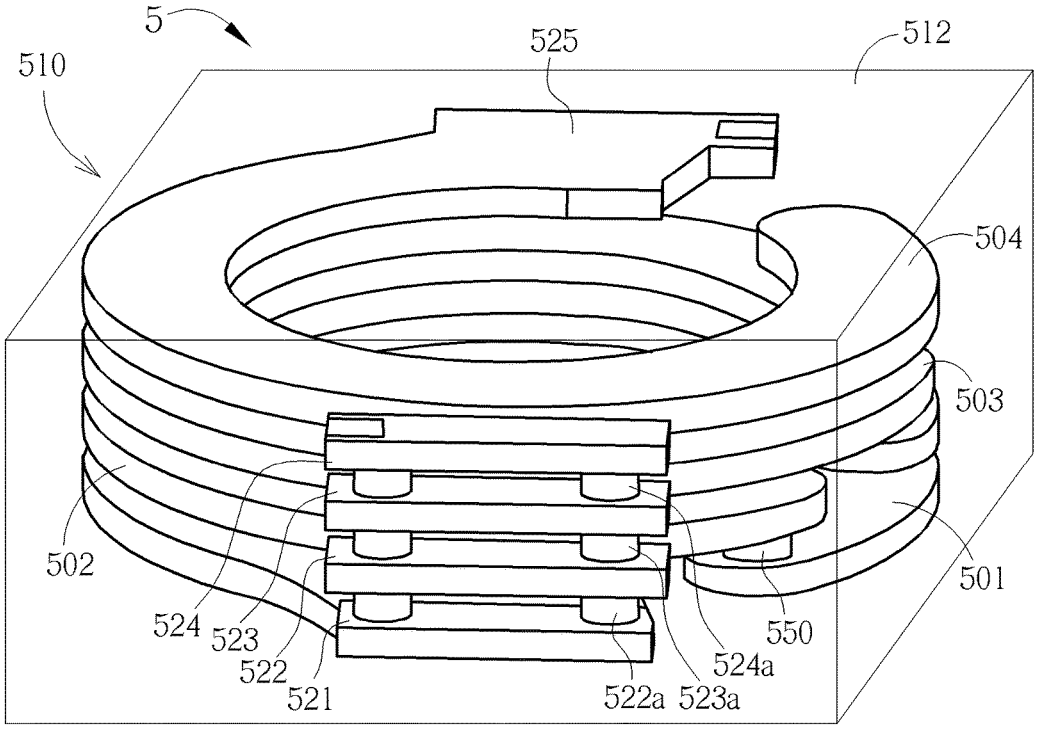

FIG. 13 and FIG. 14 illustrate an exemplary electromagnetic component according to another embodiment of this invention. FIG. 13A and FIG. 13B are different perspective views of a coil portion of the electromagnetic component. FIG. 14A to FIG. 14D are layer-by-layer layout diagrams showing each layer of the coil portion of the electromagnetic component in FIG. 13. As shown in FIG. 13 and FIG. 14, an electromagnetic component 5 has a coil portion 510. The coil portion 510 is a multi-layer circuit coil structure stacked layer-by-layer on a substrate 500. In this case, each coil layer of the coil portion 510 is an open circle shaped circuit pattern. The coil layers are interconnected to each other by using misaligned vias 550, 552, 554 with dielectric films or insulating films intervening therebetween. A central opening 500*a* may be formed in the multi-layer circuit coil structure, which may be filled with a molded body 512 comprising resins and magnetic powder, thereby forming a central pillar 512*a* within the central opening 500*a* (FIG. 14).

Figure 14A:
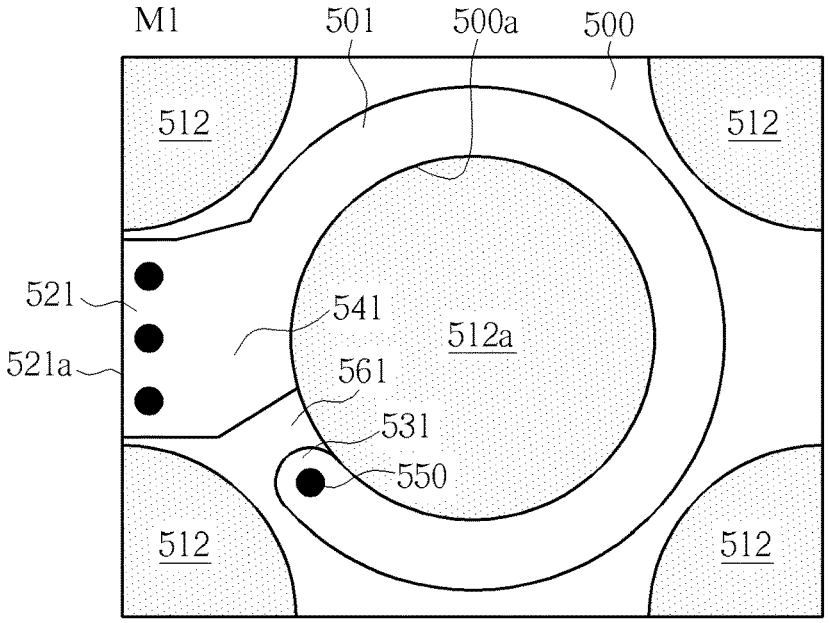
FIG. 14A to FIG. 14D are layer-by-layer layout diagrams showing each layer of the coil portion of the electromagnetic component in FIG. 13.

As shown in FIG. 14A, the first-layer (M1) coil pattern 501 has one end including an extended segment 521 connected to a distal end portion 541. A slit 561 is formed between the distal end portion 541 and the other distal end portion 531 of the first-layer coil pattern 501. The via 550 is situated at the distal end portion 531 to electrically connected the first-layer coil pattern 501 to a second-layer coil pattern 502. The extended segment 521 may have an exposed side surface 521*a* not covered by the molded body 512 to electrically coupled to an external electrode.

Figure 14B:
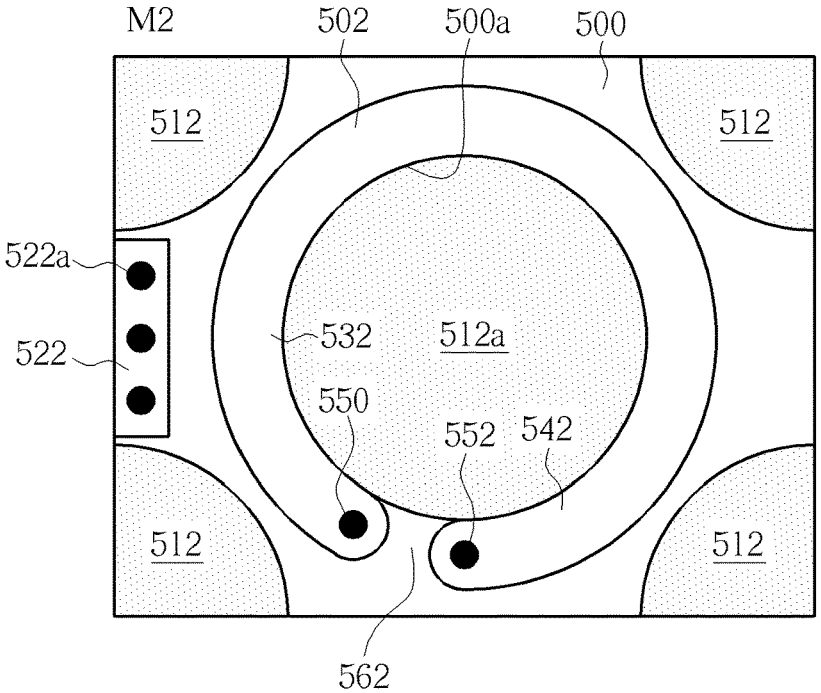

As shown in FIG. 14B, likewise, the second-layer (M2) coil pattern 502 has two distal end portions 532, 542 and a slit 562 therebetween. The slit 561 is not aligned with the slit 562 when viewed from the above and has an offset therebetween. The via 552 is situated at the distal end portion 542 to electrically connected the second-layer coil pattern 502 to a third-layer coil pattern 503.

Figure 14C:
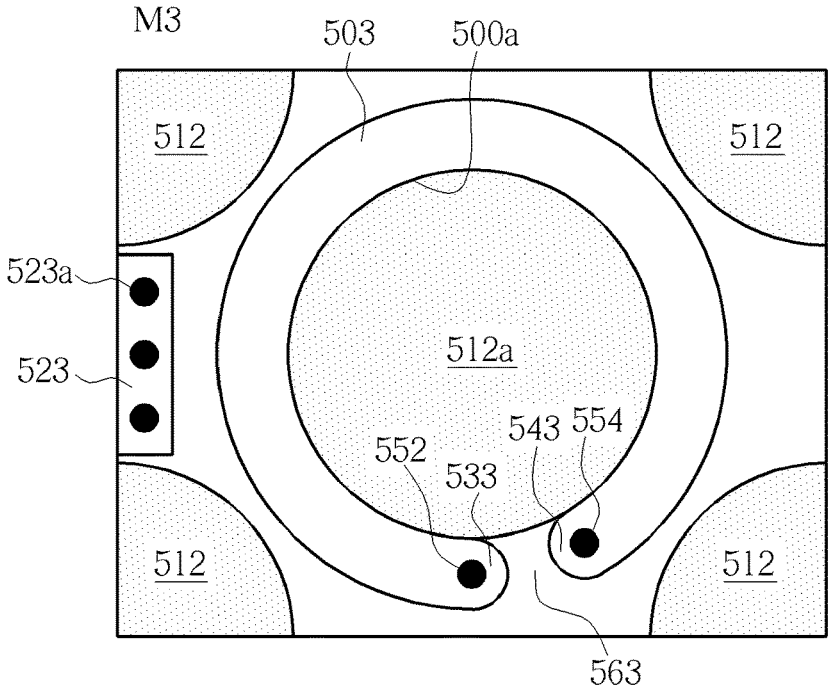

As shown in FIG. 14C, the third-layer (M3) coil pattern 503 has two distal end portions 533, 543 and a slit 563 therebetween. The slit 562 is not aligned with the slit 563 when viewed from the above and has an offset therebetween. The via 554 is situated at the distal end portion 543 to electrically connected the third-layer coil pattern 503 to a fourth-layer coil pattern 504.

Figure 14D:
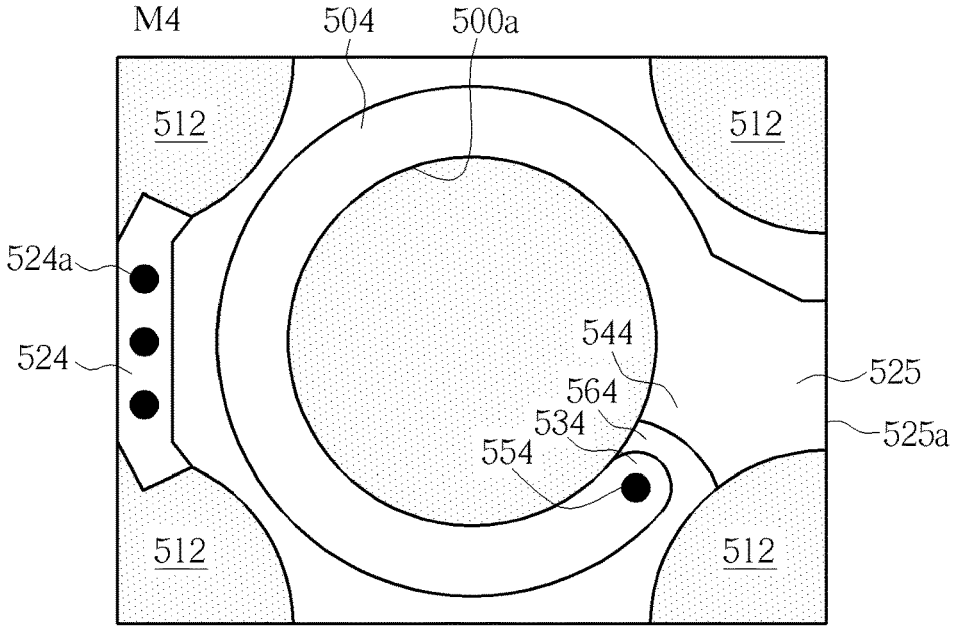

As shown in FIG. 14D, the fourth-layer (M4) coil pattern 504 has an extended segment 525 connected to a distal end portion 544. A slit 563 is formed between the two distal end portions 534, 544. The via 554 is situated at the distal end portion 534 to electrically connected the fourth-layer coil pattern 504 to a third-layer coil pattern 503. The extended segment 525 may have an exposed side surface 525*a* not covered by the molded body 512 to electrically coupled to an external electrode. Further, the extended segment 521 may be stacked with interconnect layers 522, 523, 524 and vias 522*a*, 523*a*, 524*a* such that coplanar electrodes can be formed. It is to be understood that the electromagnetic component of the invention may have more layers of coil pattern in other embodiments.

Figure 15:
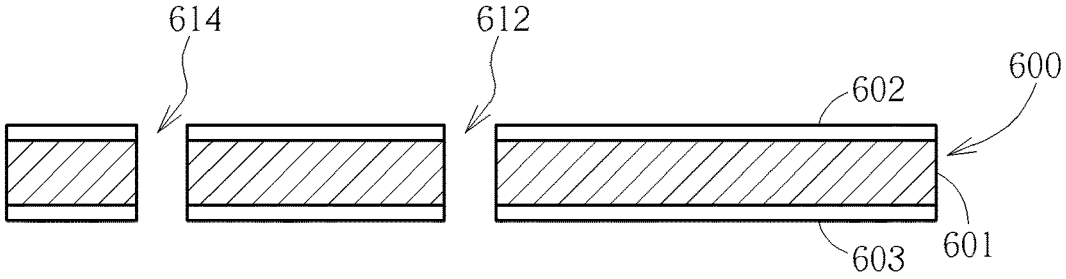
FIGS. 15-23 are schematic, cross-sectional diagrams showing a method for fabricating an electromagnetic component in accordance with another embodiment of this invention.

FIG. 15 to FIG. 23 are schematic, cross-sectional diagrams showing a method for fabricating an electromagnetic component in accordance with another embodiment of this invention. As shown in FIG. 15, first, a substrate 600 is provided. The substrate 600 includes an insulating core 601 and copper foils 602, 603 covering the two opposite surfaces of the insulating core 601. A drilling process such as mechanical drilling process is performed to form through holes 612, 614 in the substrate 600.

Figure 16:
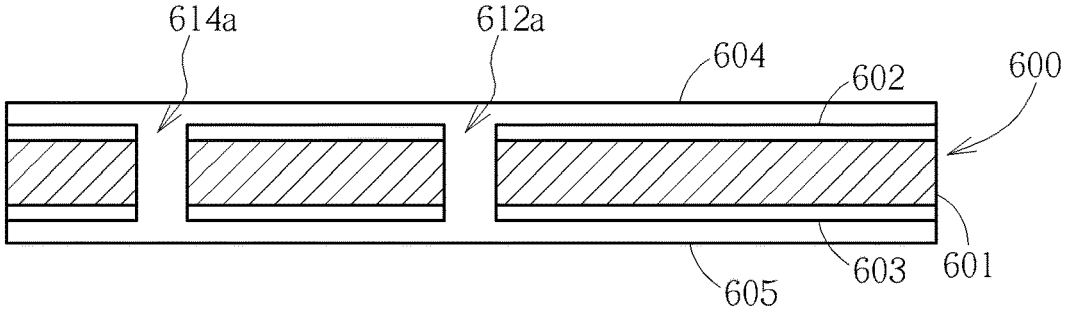

As shown in FIG. 16, a plating process is performed to form plated copper layers 604, 605 on the copper foils 602, 603 respectively. The plated copper layers 604, 605 completely fill the through holes 612, 614, thereby forming vias 612*a*, 614*a*.

Figure 17:
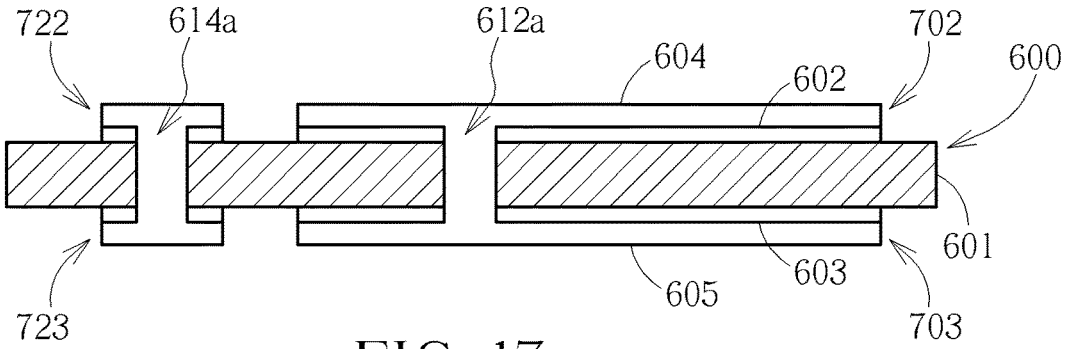

As shown in FIG. 17, a circuit pattern etching process is then performed to etch the plated copper layers 604, 605 and the copper foils 602, 603, thereby forming circuit patterns 702, 703, and circuit patterns 722, 723. The circuit patterns 702, 722 may be similar to the second-layer coil pattern 502 and the interconnect layer 522 in FIG. 14B, while the circuit patterns 703, 723 may be similar to the second-layer coil pattern 503 and the interconnect layer 523 in FIG. 14C. The vias 612*a*, 614*a* may be similar to the vias 552, 523*a*.

Figure 18:
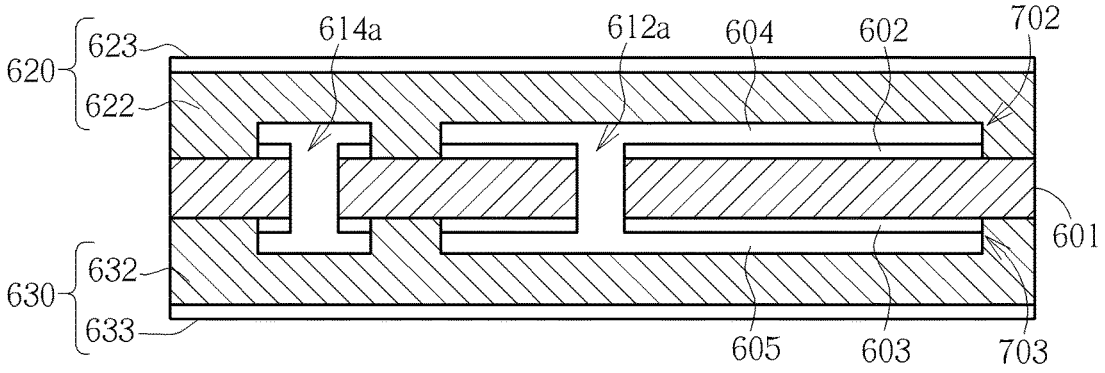

As shown in FIG. 18, subsequently, build-up layers 620, 630 such as resin coated copper foils are laminated and pressed with the substrate 600. The build-up layer 620 may include an insulating layer 622 and a copper foil 623. The build-up layer 630 may include an insulating layer 632 and a copper foil 633.

Figure 19:
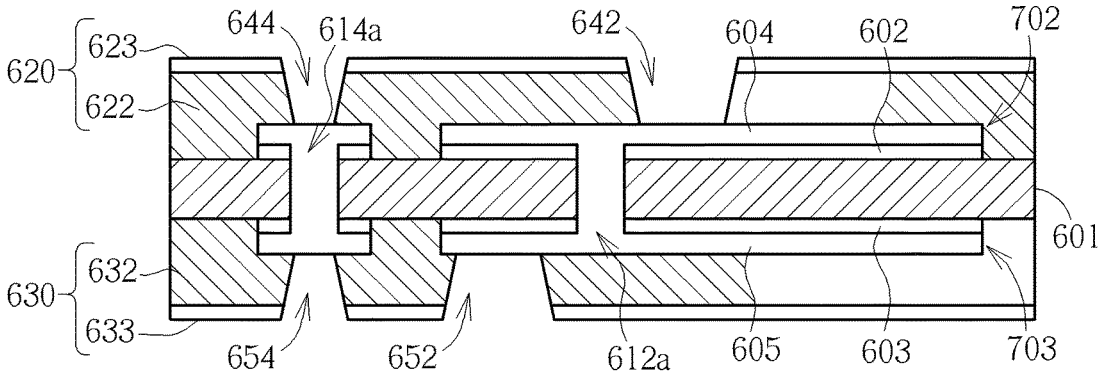

As shown in FIG. 19, by using laser ablation or drilling methods, blind vias 642, 644 are formed in the build-up layer 620, and blind vias 652, 654 are formed in the build-up layer 630. The blind vias 642, 652 expose portions of the circuit patterns 702, 703 respectively, and the blind vias 644, 654 expose portions of the circuit patterns 722, 723 respectively.

Figure 20:
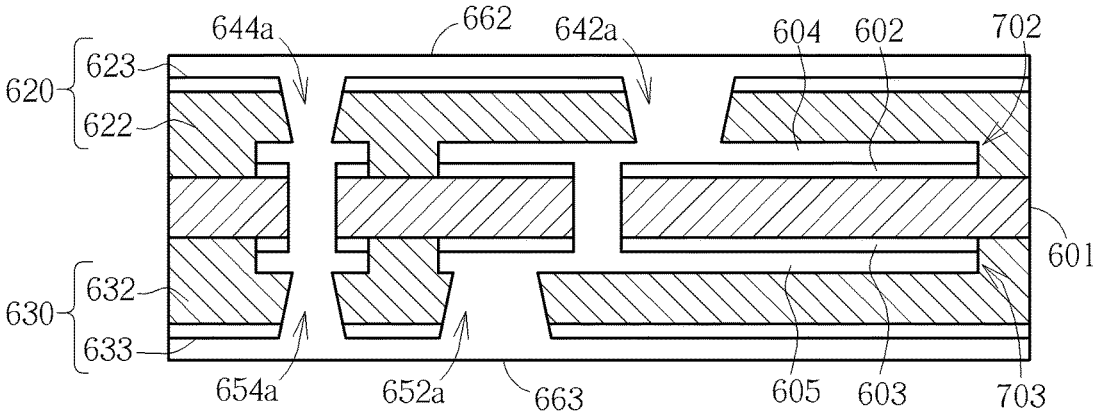

As shown in FIG. 20, a desmearing process and a copper plating process are carried out to form plated copper layers 662 and 663. The plated copper layers 662 and 663 fill the blind vias 642, 644 and blind vias 652, 654, to thereby form vias 642*a*, 644*a* and vias 652*a*, 654*a*.

Figure 21:
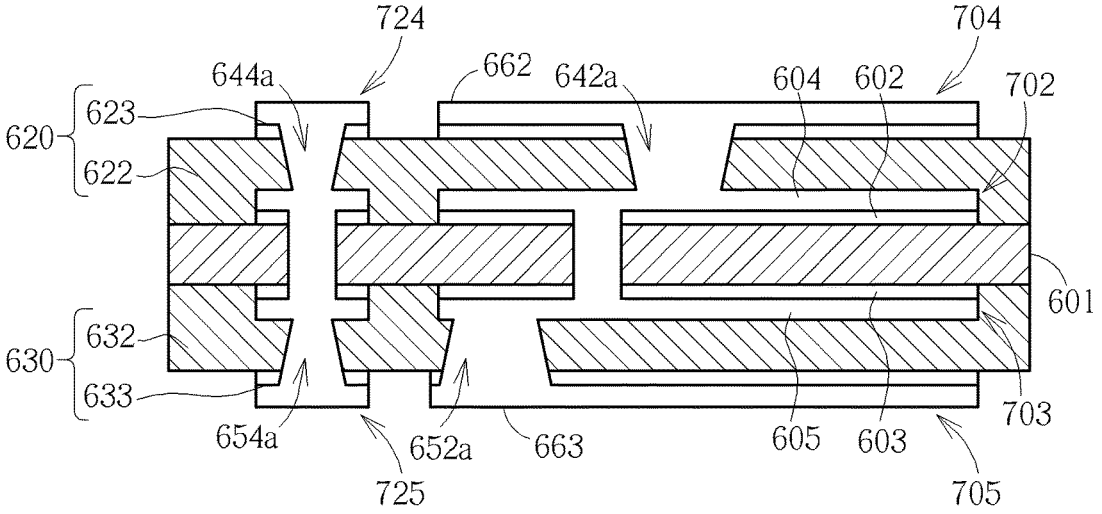

As shown in FIG. 21, a circuit pattern etching process is performed to etch the plated copper layers 662, 663 and copper foils 623,633 into circuit patterns 704, 705 and circuit patterns 724, 725. The circuit patterns 704, 724 may be similar to the first-layer coil pattern 501 and the extended segment 521 in FIG. 14A, while the circuit patterns 705, 725 may be similar to the fourth-layer coil pattern 504 and the interconnect layer 524 in FIG. 14D. The vias 642*a*, 644*a* may be similar to the vias 550, 522*a* in FIG. 14A. The vias 652*a*, 654*a* may be similar to the vias 554, 524*a* in FIG. 14D.

Figure 22A:
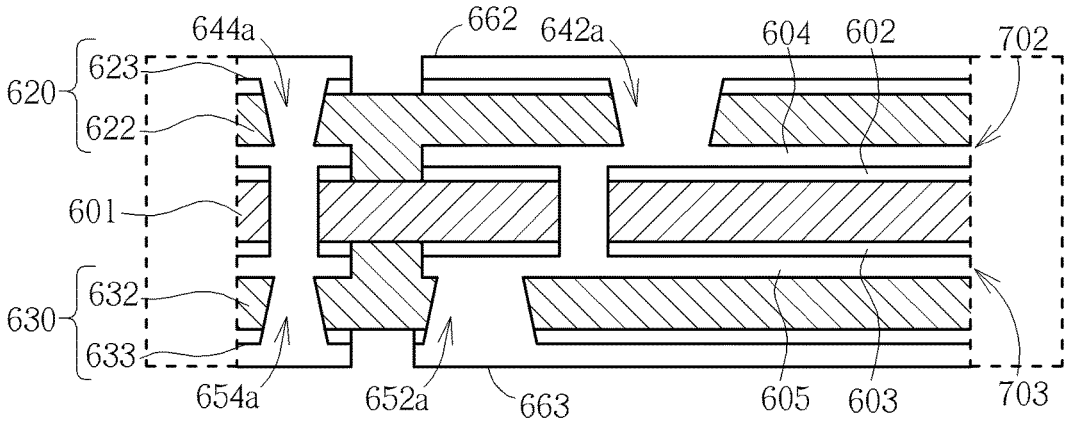
Figure 22B:
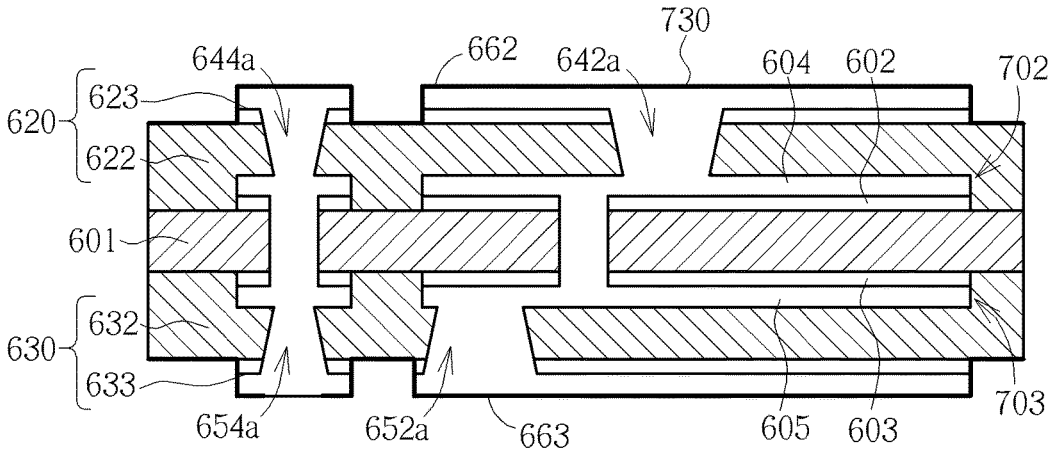
Figure 23A:
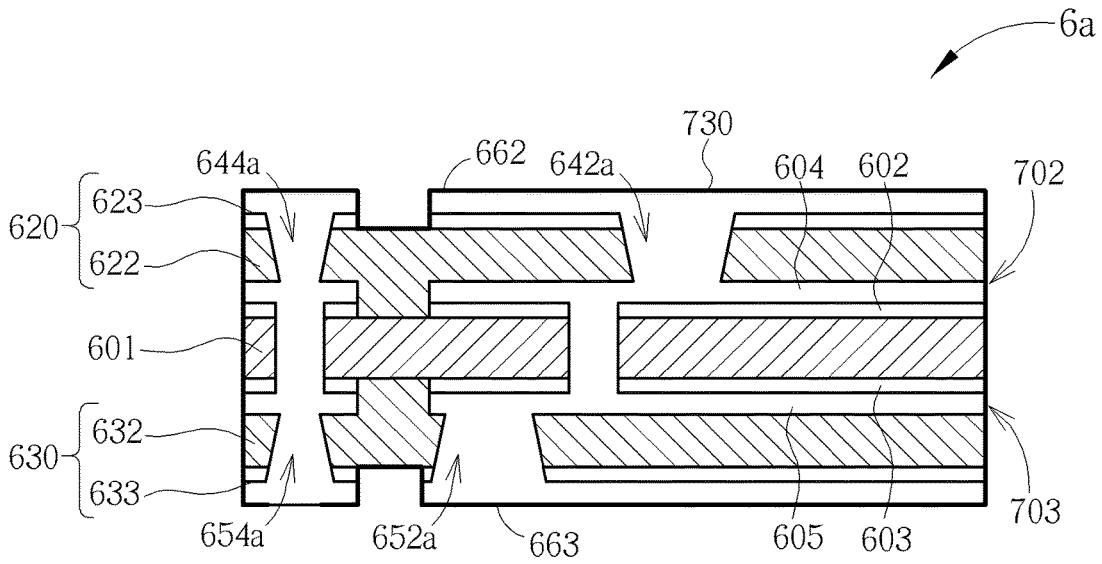
Figure 23B:
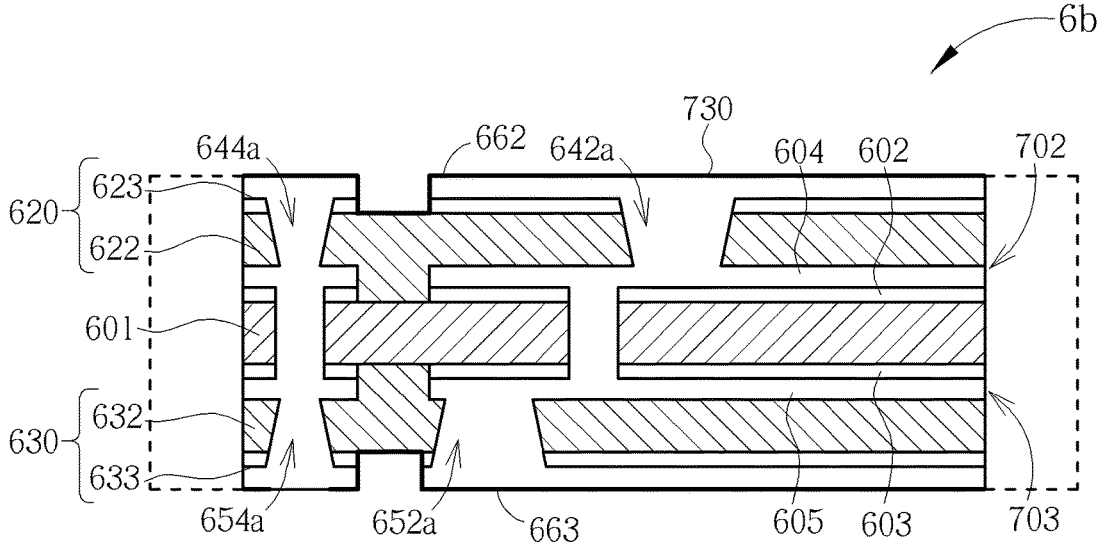

As shown in FIG. 22A and FIG. 23A, a mechanical drilling process or a micro-etching process may be performed to remove a portion of the insulating layers 622, 632 and the insulating core 601. Subsequently, an insulating protection layer 730 is coated to complete a discrete, unpackaged electromagnetic component 6*a*. Alternatively, as shown in FIG. 22B and FIG. 23B, the insulating protection layer 730 may be printed first, followed by mechanical drilling process or micro-etching process to remove a portion of the insulating protection layer 730, the insulating layers 622, 632 and the insulating core 601, thereby completing a discrete, unpackaged electromagnetic component 6*b*. The discrete, unpackaged electromagnetic component 6*a*, 6*b* may be packaged by using magnetic material comprising resins and magnetic powder.

Figure 24:
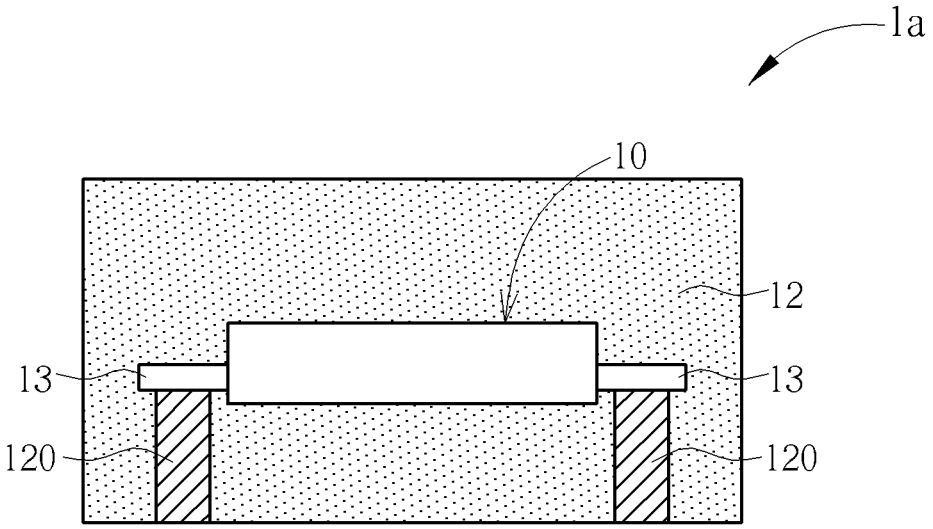
FIGS. 24 and 25 illustrate exemplary configurations of the packaged electromagnetic components in accordance with other embodiments of this invention.
Figure 25:
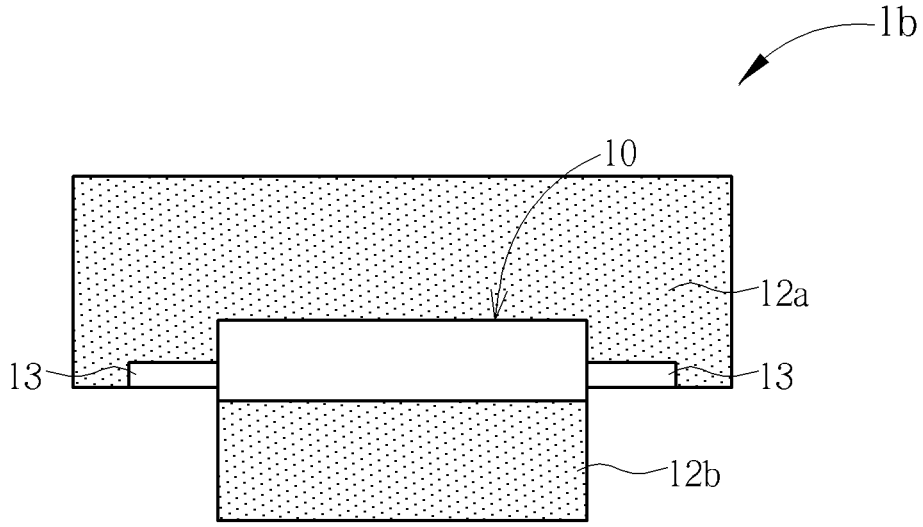

FIGS. 24 and 25 illustrate exemplary configurations of the packaged electromagnetic components in accordance with other embodiments of this invention.

As shown in FIG. 24, the electromagnetic component 1*a* comprises a single-winding coil portion 10 as set forth in FIG. 1, which is encapsulated by a molded body 12 formed in a shape of, for example, rectangular parallelepiped. Two electrodes 13 are respectively coupled to two terminals of the coil portion 10. The electrodes 13 may be completely encompassed by the molded body 12. The molded body 12 may comprise magnetic material including but not limited to thermosetting resins and metallic powder such as ion powder, ferrite powder, metallic powder or any suitable magnetic materials known in the art. Two conductive elements or plugs 120 are embedded in the molded body 12 to electrically connect the two electrodes 13 to a circuit board or a module (not shown).

As shown in FIG. 25, the electromagnetic component 1*b* comprises a single-winding coil portion 10 as set forth in FIG. 1, which is partially encapsulated by molded body 12*a* and molded body 12*b*. Two electrodes 13 are respectively coupled to two terminals of the coil portion 10. The electrodes 13 may be partially exposed from the molded body 12*a* and molded body 12*b*.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electromagnetic component, comprising:

a substrate;

a conductive structure on the substrate, wherein the conductive structure comprises a coil formed in a plurality of conductive layers separated by at least one insulating layer, wherein the plurality of conductive layers comprise at least three conductive layers, wherein a blind via is disposed in a first insulating layer of the at least one insulating layer to electrically connect a first conductive layer and a second conductive layer, wherein a hollow space is formed inside the coil and extended from a top surface of the conductive structure to a bottom surface of the substrate, said hollow space penetrating the plurality of conductive layers and the at least one insulating layer with an inner side surface of the coil in each of the plurality of conductive layers being exposed to the hollow space; and a magnetic molding body, encapsulating the conductive structure and extending into the hollow space, wherein an outer surface of a first portion of the magnetic molding body disposed inside the hollow space is physically in contact with said inner side surface of the coil in each of the plurality of conductive layers.

2. The electromagnetic component according to claim 1, wherein a first portion of the coil disposed on the first conductive layer has two ending portions to form a first slit therebetween, wherein a first end portion of said two ending portions is electrically connected to the second conductive layer through the blind via.

3. The electromagnetic component according to claim 1, wherein a second portion of the magnetic molding body is physically in contact with a top surface of the coil.

4. The electromagnetic component according to claim 1, wherein the magnetic molding body encapsulating the conductive structure and extending into the hollow space is integrally formed.

5. An electromagnetic component, comprising:

a conductive structure, wherein the conductive structure comprises a coil formed in a plurality of conductive layers separated by a plurality of insulating layers, wherein a second conductive layer is disposed over a first conductive layer and a third conductive layer is disposed over the second conductive layer, wherein a slit is formed between a first end portion and a second end portion of a first coil pattern of the second conductive layer, wherein the first end portion of the first coil pattern is electrically connected to a second coil pattern of the first conductive layer through a first blind via disposed in a first insulating layer of the plurality of insulating layers, and the second end portion of the first coil pattern is electrically connected to a third coil pattern of the third conductive layer through a second blind via disposed in a second insulating layer of the plurality of insulating layers, and wherein a hollow space is formed inside the coil and extended from a top surface to a bottom surface of the conductive structure, said hollow space penetrating the plurality of conductive layers and the plurality of insulating layers with an inner side surface of the coil in each of the plurality of conductive layers being exposed to the hollow space; and a magnetic molding body, encapsulating the conductive structure and extending into the hollow space, wherein an outer surface of a first portion of the magnetic molding body disposed inside the hollow space is physically in contact with said inner side surface of the coil in each of the plurality of conductive layers.

6. The electromagnetic component according to claim 5, wherein a second portion of the magnetic molding body is physically in contact with a top surface of the coil.

* * * * *